US009472887B1

(12) United States Patent
Horning et al.

(10) Patent No.: US 9,472,887 B1
(45) Date of Patent: Oct. 18, 2016

(54) ELECTRICAL CONNECTOR HAVING A GROUND BRACKET

(71) Applicant: Tyco Electronics Corporation, Berwyn, PA (US)

(72) Inventors: Michael James Horning, Lancaster, PA (US); Wayne Samuel Davis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/693,379

(22) Filed: Apr. 22, 2015

(51) Int. Cl.
*H01R 13/502* (2006.01)
*H01R 13/6588* (2011.01)

(52) U.S. Cl.
CPC ..... *H01R 13/502* (2013.01); *H01R 13/6588* (2013.01)

(58) Field of Classification Search
CPC ..... H01R 13/514; H01R 13/646; H01R 13/6461; H01R 13/648; H01R 13/658; H01R 13/6586; H01R 13/6588; H01R 23/688; H01R 13/502
USPC ..... 439/660, 101, 108, 225, 607.05, 439/607.06, 607.12, 607.53, 701
See application file for complete search history.

(56) References Cited

U.S. PATENT DOCUMENTS 3,743,979 A * 7/1973 Schor ..... H01R 13/7197 333/182
4,029,386 A * 6/1977 Krantz, Jr. ..... H01R 13/7197 333/182
4,126,370 A * 11/1978 Nijman ..... H01R 13/7197 333/182
4,362,350 A * 12/1982 von Harz ..... H01R 13/426 439/607.12
4,568,133 A * 2/1986 Amano ..... H01R 13/6485 439/108
4,580,863 A * 4/1986 Lohr ..... H01R 31/08 439/271
4,737,116 A * 4/1988 Slye ..... H01R 23/688 333/32
4,875,865 A * 10/1989 Demler, Jr. ..... H01R 12/716 439/101
5,064,390 A * 11/1991 Umesato ..... H01R 23/688 439/579
5,257,949 A * 11/1993 Paulus ..... H01R 13/7197 333/185
5,310,364 A * 5/1994 Hooper ..... H01R 31/08 439/206
5,554,050 A * 9/1996 Marpoe, Jr. ..... H01R 13/7195 333/181
5,620,340 A * 4/1997 Andrews ..... H01R 23/688 439/108
5,692,917 A * 12/1997 Rieb ..... H01R 13/6397 340/543
6,027,349 A * 2/2000 Chang ..... H01R 13/648 439/101
6,471,548 B2 * 10/2002 Bertoncini ..... H01R 23/688 439/607.1
6,743,057 B2 * 6/2004 Davis ..... H01R 23/688 439/607.05
7,381,092 B2 * 6/2008 Nakada ..... H01R 13/514 439/607.1
8,771,023 B2 * 7/2014 De Bruijn ..... H01R 23/688 439/701

* cited by examiner

*Primary Examiner* — Neil Abrams
*Assistant Examiner* — Travis Chambers

(57) ABSTRACT

An electrical connector includes a housing stack, signal and ground conductors, and an electrically conductive ground bracket. The housing stack comprises a front housing and a rear housing. The front housing defines a mating end of the housing stack, and the rear housing defines a mounting end of the housing stack. The housing stack defines signal cavities and ground cavities that extend continuously through the front housing and the rear housing. The signal conductors and ground conductors are held in the signal cavities and ground cavities, respectively, of the housing stack. The signal conductors are arranged in signal pairs, and the ground conductors are interleaved between the signal pairs. The ground bracket is held in the housing stack between the front housing and the rear housing. The ground bracket engages and is electrically connected to each of the ground conductors to electrically common the ground conductors along a ground plane.

20 Claims, 7 Drawing Sheets

ELECTRICAL CONNECTOR HAVING A GROUND BRACKET

BACKGROUND OF THE INVENTION

The subject matter herein relates generally to electrical connector systems.

Some electrical connector systems utilize electrical connectors to interconnect two circuit boards, such as a motherboard and daughter card. Signal loss and/or signal degradation is a problem in known electrical systems. For example, crosstalk results from an electromagnetic coupling of the fields surrounding an active conductor (or differential pair of conductors) and an adjacent conductor (or differential pair of conductors). The strength of the electromagnetic coupling generally depends on the separation between the conductors, such that crosstalk may be significant when the electrical connectors are placed in close proximity to each other. Moreover, as speed and performance demands increase, known electrical connectors are proving to be insufficient. Additionally, there is a desire to increase the density of electrical connectors to increase throughput of the electrical system, without an appreciable increase in size of the electrical connectors, and in some cases, with a decrease in size of the electrical connectors. Such an increase in density and/or reduction in size causes further strains on performance.

In order to address performance, some electrical connectors have been developed that utilize shielding between pairs of signal contacts. The shielding is provided in both connectors along the signal lines, such as through ground contacts. Typically, the individual shields are electrically commoned in both circuit boards. However, the shields remain electrically independent between the circuit boards. The signal lines may experience degradation, such as resonance noise, along their lengths through the electrical connectors. The resonance noise is due to standing electromagnetic waves created at the ends of the ground contacts that propagate along the ground contacts and cause the electrical potential of the ground contact to vary along the length, referred to as resonance spikes. The resonance noise can couple to the pairs of signal contacts to degrade the signal performance. The resonance noise and crosstalk between pairs of signal contacts increases as the electrical connectors are used to convey more data at faster data rates and transmitted at higher frequencies. The resonance noise also increases as the length of the ground contacts between grounding locations increases.

A need remains for an electrical connector that reduces resonance noise to improve signal performance of an electrical connector system.

BRIEF DESCRIPTION OF THE INVENTION

In an embodiment, an electrical connector is provided that includes a housing stack, signal and ground conductors, and a ground bracket. The housing stack comprises a front housing and a rear housing. The front housing defines a mating end of the housing stack. The rear housing defines a mounting end of the housing stack. The rear housing is positioned rearward of the front housing. The housing stack defines signal cavities and ground cavities that extend continuously through the front housing and the rear housing between the mating end and the mounting end. The signal conductors and ground conductors are held in the signal cavities and ground cavities, respectively, of the housing stack. The signal conductors are arranged in a plurality of signal pairs configured to carry differential signals. The ground conductors are interleaved between the signal pairs. The ground bracket is held in the housing stack between the front housing and the rear housing. The ground bracket is electrically conductive. The ground bracket engages and is electrically connected to each of the ground conductors to electrically common the ground conductors along a ground plane that is intermediate between the mating end and the mounting end.

In another embodiment, an electrical connector is provided that includes a housing stack, signal and ground conductors, and first and second ground brackets. The housing stack comprises a front housing, a spacer member, and a rear housing. The front housing defines a mating end of the housing stack. The rear housing defines a mounting end of the housing stack. The spacer member is disposed between the front housing and the rear housing. The housing stack defines signal cavities and ground cavities that extend continuously through the front housing, the spacer member, and the rear housing between the mating end and the mounting end. The signal conductors and the ground conductors are held in the signal cavities and ground cavities, respectively, of the housing stack. The signal conductors are arranged in a plurality of signal pairs configured to carry differential signals. The ground conductors are interleaved between the signal pairs. The first and second ground brackets are held in the housing stack. The first and second ground brackets are each electrically conductive. The first ground bracket is disposed between the front housing and the spacer member. The first ground bracket engages and electrically connects to each of the ground conductors to electrically common the ground conductors along a first ground plane. The second ground bracket is disposed between the spacer member and the rear housing. The second ground bracket engages and is electrically connected to each of the ground conductors to electrically common the ground conductors along a second ground plane that is spaced apart axially from the first ground plane. The first ground plane and the second ground plane are located between the mating end and the mounting end.

DETAILED DESCRIPTION OF THE INVENTION

Figure 1:
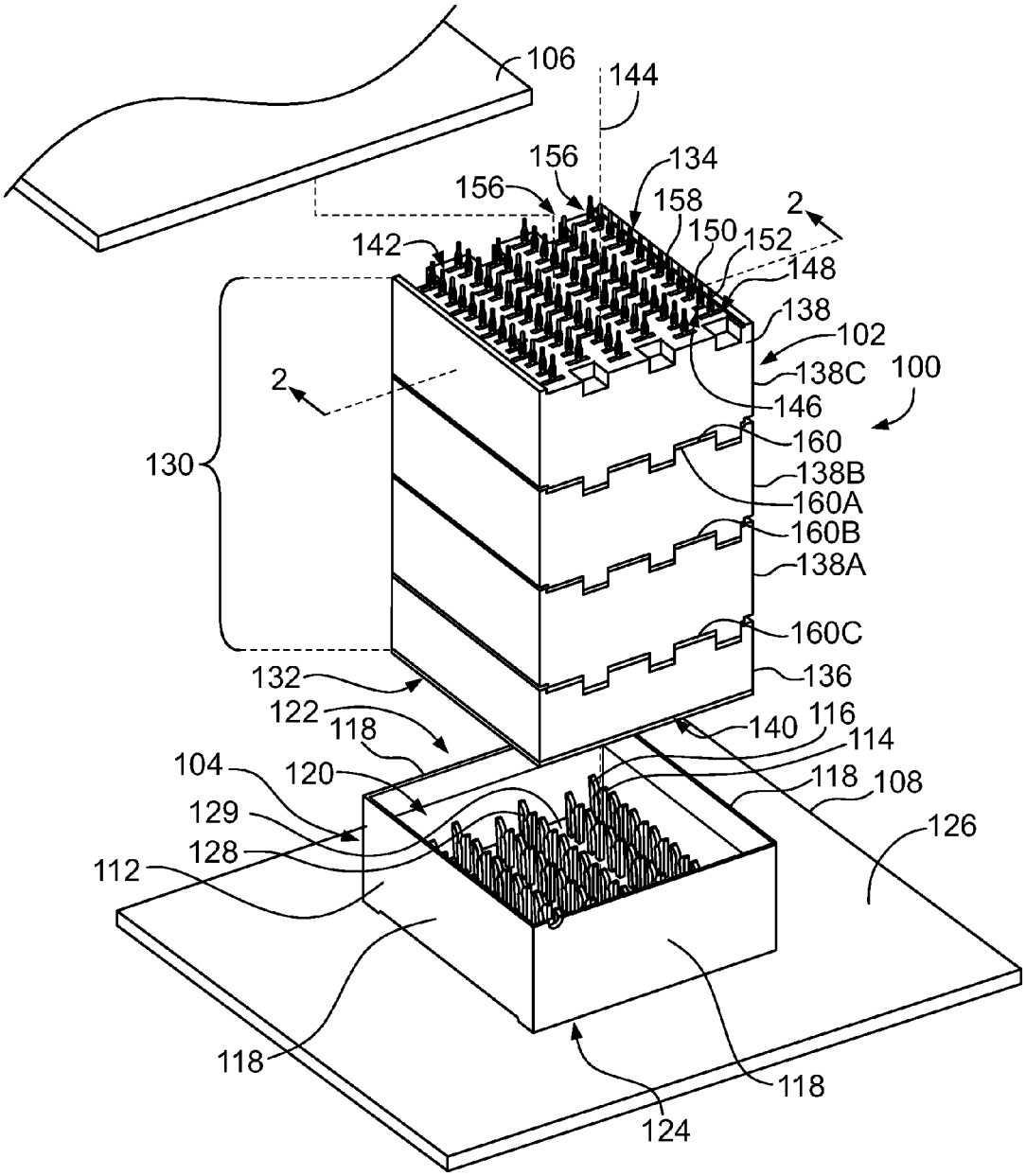
FIG. 1 is a top perspective view of an electrical connector system formed in accordance with an embodiment.

FIG. 1 is a top perspective view of an electrical connector system 100 formed in accordance with an embodiment. The electrical connector system 100 includes a first electrical connector 102 and a second electrical connector 104 that are configured to be directly mated together. In FIG. 1, the first electrical connector 102 and the second electrical connector 104 are shown un-mated, but poised for mating to one another. The first electrical connector 102 and the second electrical connector 104 are configured to be electrically connected to respective first and second circuit boards 106, 108. The first and second electrical connectors 102, 104 are utilized to provide a signal transmission path to electrically connect the circuit boards 106, 108 to one another at a separable mating interface. In FIG. 1, the second electrical connector 104 is mounted to the corresponding second circuit board 108. The first circuit board 106 in FIG. 1 is shown spaced apart from the first electrical connector 102 for clarity in order to show details of a mounting end 134 of the first electrical connector 102. In an embodiment, the first and second circuit boards 106, 108 are oriented parallel to one another when the first and second electrical connectors 102, 104 are mated. Alternative relative orientations of the circuit boards 106, 108, such as a perpendicular orientation, are possible in other embodiments. In an alternative embodiment, the first electrical connector 102 and/or the second electrical connector 104 may be terminated to one or more cables rather than being board mounted.

In an exemplary embodiment, the first electrical connector 102 is a receptacle connector, and is referred to herein as receptacle connector 102. In addition, the second electrical connector 102 is a header or mating connector in an exemplary embodiment, and is referred to herein as a header connector 104. Although one or more embodiments shown and described below describe the receptacle connector 102 as having an extended length due to multiple stackable modules (such as rear housings 138, for example), it is recognized that in an alternative embodiment, the stackable modules and/or other components of the receptacle connector 102 may be part of the header connector 104 instead of, or in addition to, being part of the receptacle connector 102.

The electrical connector system 100 may be disposed on or in an electrical component, such as a server, a computer, a router, or the like. The electrical component may include other electrical devices in addition to the electrical connector system 100 and located near the electrical connector system 100. Due to space constraints in or on the electrical component, it may be useful to vary the height of the electrical connector system 100 in order to vary the distance between the first and second circuit boards 106, 108. For example, one or more electrical devices disposed on or near the second circuit board 108 may contact the first circuit board 106, interfering with the mating between the receptacle and header connectors 102, 104, when the electrical connector system 100 has a first height. But, if the connector system 100 has a taller height such that the first circuit board 106 does not move as close to the second circuit board 108 during mating, the first circuit board 106 may be sufficiently spaced apart from the second circuit board 108 during mating such that the first circuit board 106 clears the one or more electrical devices on or near the second circuit board 108, allowing for unimpeded mating of the receptacle and header connectors 102, 104. In an embodiment, the receptacle connector 102 is modular in design, having any number of modules or units stacked together to adjust the height of the receptacle connector 102, and thus the height of the connector system 100. Alternatively, or in addition, the header connector 104 may be modular and have any number of stackable modules or units to adjust the height of the header connector 104.

In the illustrated embodiment, the header connector 104 includes a header housing 112 and a plurality of signal contacts 114 and ground contacts 116. The header housing 112 extends between a mating end 122 and a mounting end 124. The header housing 112 includes multiple outer walls 118 that define a socket 120 therebetween. The socket 120 is open at the mating end 122 of the header housing 112 and is configured to receive a portion of the receptacle connector 102 therein. The header housing 112 may be box-shaped with four outer walls 118. All or at least some of the outer walls 118 may be beveled at the mating end 122 to provide a lead-in section to guide the receptacle connector 102 into the socket 120 during mating. In the illustrated embodiment, the header housing 112 has a fixed height between the mating end 122 and the mounting end 124. The header housing 112 may be formed of at least one dielectric material, such as a plastic or one or more other polymers. The mounting end 124 of the header housing 112 faces, and may also engage, a surface 126 of the second circuit board 108.

The signal contacts 114 and ground contacts 116 protrude through a base wall 129 of the header housing 112 into the socket 120. The base wall 129 extends between the outer walls 118 and defines a back wall of the socket 120. The signal contacts 114 and the ground contacts 116 are formed of a conductive material, such as copper, a copper alloy, and/or another metal or metal alloy. In the illustrated embodiment, the signal contacts 114 and the ground contacts 116 each include a pin 128 that extends into the socket 120. Although not clearly shown in FIG. 1, the pins 128 of the ground contacts 116 may be longer than the pins 128 of the signal contacts 114 in order to ensure that a grounding path or circuit is established during a mating operation between the connectors 102, 104 before a signal path or circuit is established. The signal contacts 114 and the ground contacts 116 also each include a terminating segment (not shown) that is configured to engage and electrically connect to a corresponding conductor (also not shown) of the circuit board 108. The conductors may be embodied in electric pads or traces deposited on one or more layers of the circuit board 108, in plated vias, or in other conductive pathways, contacts, and the like.

The receptacle connector 102 includes a housing stack 130 that extends between a mating end 132 and a mounting end 134. The housing stack 130 is modular and includes at least a front housing 136 and a rear housing 138, which are stackable modules or units. The front housing 136 has a front side 140 that defines the mating end 132. A rear side 142 of the rear housing 138 defines the mounting end 134. The housing stack 130 extends along a stack axis 144. The rear housing 138 is positioned or located rearward of the front housing 136. As used herein, relative or spatial terms such as "top," "bottom," "front," "rear," "left," and "right" are only used to distinguish the referenced elements and do not necessarily require particular positions or orientations in the electrical connector system 100 or in the surrounding environment of the electrical connector system 100.

In one embodiment, the housing stack 130 may include only the front housing 136 and the rear housing 138, such that no other modules or units of the housing stack 130 separate the front housing 136 from the rear housing 138. In other embodiments, however, the housing stack 130 may include more than one rear housing 138, such that the housing stack 130 includes at least one intermediary rear housing 138 located between the front housing 136 and the rear housing 138 in the housing stack 130. As used herein, each intermediary rear housing 138 is referred to as a "spacer member," since the intermediary rear housings 138 increase the length of the housing stack 130. The spacer members 138 may be substantially identical to the rear housing 138, such that each spacer member 138 and the rear housing 138 may have substantially the same shape, size, and/or composition. For example, the front housing 136, the rear housing 138, and the spacer members 138 may be composed of one or more dielectric materials, such as a plastic or one or more other polymers. In addition, the rear housing 138 and the spacer members 138 may be formed by the same process, such as by being molded using the same mold. In an alternative embodiment, the rear housing 138 is not substantially identical to the spacer members 138.

The housing stack 130 may include zero spacer members 138, one spacer member 138, or two or more spacer members 138 between the front housing 136 and the rear housing 138. In the illustrated embodiment, the housing stack 130 includes two spacer members 138, such that a first spacer member 138A is positioned between the front housing 136 and a second spacer member 138B, and the second spacer member 138B is positioned between the first spacer member 138A and the rear housing 138C.

The housing stack 130 defines signal cavities 146 and ground cavities 148 that extend through the housing stack 130 between the mating end 132 and the mounting end 134. The signal cavities 146 and the ground cavities 148 extend continuously through the modules of the housing stack 130, including through the front housing 136, the rear housing 138C, and any intervening spacer members 138A, 138B. The signal and ground cavities 146, 148 are shown in more detail in FIG. 2. The receptacle connector 102 also includes a plurality of signal conductors 150 and ground conductors 152 that are held in the signal cavities 146 and the ground cavities 148, respectively, of the housing stack 130. Each signal conductor 150 is held in a corresponding signal cavity 146, and each ground conductor 152 is held in a corresponding ground cavity 148. In an embodiment, the signal conductors 150 are arranged in a plurality of signal pairs that are configured to carry differential signals. The ground conductors 152 are interleaved between the signal pairs. For example, the signal and ground conductors 150, 152 may be arranged in an array that includes multiple columns 156. In each column 156, the signal and ground conductors 150, 152 are oriented such that the two signal conductors 150 of each signal pair are directly next to each other and the signal pair is bordered on each side by at least one ground conductor 152. This arrangement may be referred to as a repeatable ground-signal-signal-ground (GSSG) pattern. In some embodiments, a single ground conductor 152 may be positioned or interleaved between adjacent signal pairs of signal conductors 150, while, in other embodiments, adjacent signal pairs are separated by two ground conductors 152.

The signal conductors 150 and the ground conductors 152 may extend for at least most of the length or height of the housing stack 130 between the mating end 132 and the mounting end 134. The signal conductors 150 and the ground conductors 152 may extend parallel to the stack axis 144. In the illustrated embodiment, the signal and ground conductors 150, 152 each have a terminating interface 158 that extends beyond the rear side 142 of the rear housing 138C at the mounting end 134 for electrical termination to corresponding conductors (not shown) on the first circuit board 106. The terminating interface 158 may be an eye-of-the-needle pin (shown in more detail in FIG. 2), which is configured to be through-hole mounted to a corresponding via of the circuit board 106. Alternatively, at least some of the terminating interfaces 158 may be bent tails configured to be soldered or otherwise surface mounted to conductive pads on the circuit board 106.

In an embodiment, the receptacle connector 102 further includes at least one ground bracket 160 held in the housing stack 130 between the front housing 136 and the rear housing 138C. Each ground bracket 160 is electrically conductive. Each ground bracket 160 extends transverse to the stack axis 144. For example, ground brackets 160 may be oriented orthogonal or perpendicular to the stack axis 144. The one or more ground brackets 160 are configured to engage and electrically connect to each of the ground conductors 152 to electrically common the ground conductors 152 along a ground plane. In an embodiment, the receptacle connector 102 includes multiple ground brackets 160 that are spaced apart from one another axially along the length of the ground conductors 152 (and along the height of the housing stack 130) in order to electrically common the same ground conductors 152 at multiple axial locations.

The ground conductors 152 are configured to provide shielding between the signal pairs of signal conductors 150 along the length (or height) of the housing stack 130. The individual ground paths formed by the ground conductors 152 and the corresponding ground contacts 116 of the header connector 104 may be electrically commoned in both circuit boards 106, 108. The ground brackets 160 provide ground planes to common the ground conductors 152 between the circuit boards 106, 108. Electromagnetic interference (EMI), such as resonance noise and crosstalk, between pairs of signal conductors 150 generally increases with increasing data transfer rates, frequencies, and lengths of the ground paths between grounding locations. Such resonance noise and crosstalk may degrade the signal integrity and performance of the electrical connector system 100. In an embodiment, the one or more ground planes provided by the one or more ground brackets 160 are each a grounding location, which reduces the ground path length between grounding locations, thereby improving signal integrity by reducing resonance noise and crosstalk within the connector system 100. For example, shortening the ground path length of the ground conductors 152 may reduce the magnitude of resonance peaks in resonance waves that propagate through the ground conductors 152 within the receptacle connector 102.

In addition, ground path length affects the resonance frequency of the ground conductors 152. A longer ground path length corresponds with a relatively lower resonance frequency, while a shorter ground path length corresponds with a relatively higher resonance frequency. Shortening the ground path length via the one or more ground brackets 160 may increase the resonance frequency to a level outside of a desired operating frequency range or band. For example, the resonance frequency may be increased to a level at which the resonance frequency does not have a detrimental effect on the signal performance of the signal conductors 150. The resonance frequency may be increased to a level at or above 12 GHz, 16 GHz, 20 GHz, or the like.

The ground brackets 160 are held between the two adjacent modules of the housing stack 130. For example, in an embodiment in which the housing stack 130 does not include any spacer members 138A, 138B, a single ground bracket 160 may be located at the interface between the front housing 136 and the rear housing 138C. In another example, if the housing stack 130 includes one spacer member 138A, a first ground bracket 160 may be disposed at the interface between the front housing 136 and the spacer member 138A, and a second ground bracket 160 may be disposed at the interface between the spacer member 138A and the rear housing 138B (shown as the second spacer member 138B in FIG. 1). Therefore, the first ground bracket 160 is spaced apart from the second ground bracket 160 along the height of the housing stack 130. The first ground bracket 160 engages and electrically connects the ground conductors 152 along a first ground plane, while the second ground bracket 160 engages and electrically connects the ground conductors 152 along a second ground plane that is spaced apart axially from the first ground plane. Both the first ground plane and the second ground plane are located between the mating end 132 and the mounting end 134 of the housing stack 130. In an embodiment, the first ground plane and the second ground plane are both parallel to the mating end 132 and the mounting end 134.

In the illustrated embodiment shown in FIG. 1, the housing stack 130 includes three ground brackets 160. A first ground bracket 160A is located between the front housing 136 and the first spacer member 138A, a second ground bracket 160B is located between the first spacer member 138A and the second spacer member 138B, and a third ground bracket 160C is located between the second spacer member 138B and the rear housing 138C. The three ground brackets 160A-C engage and electrically connect to the ground conductors 152 at three different axial locations along the length of the ground conductors 152, which considerably reduces the ground path length between grounding locations.

Figure 2:
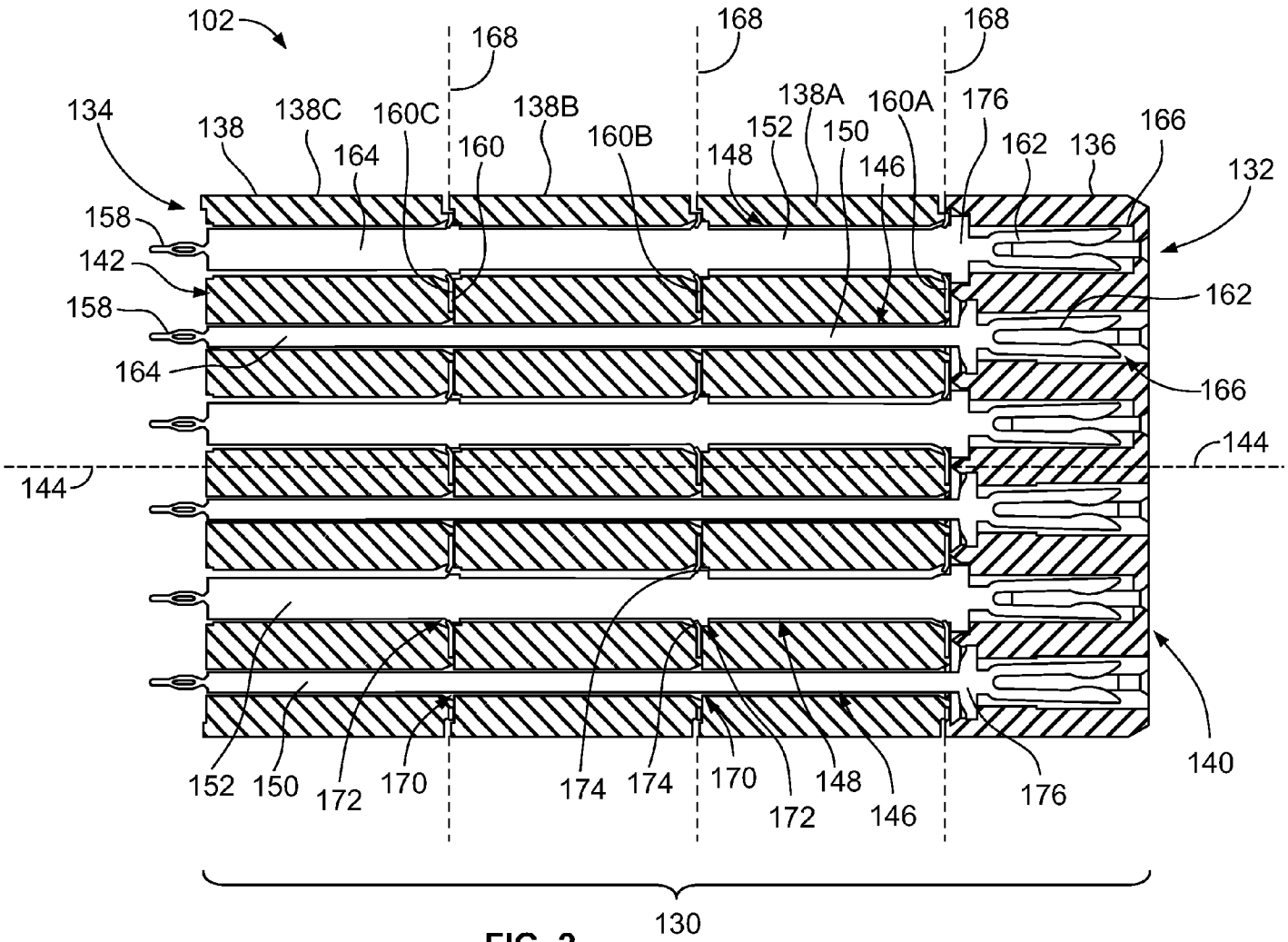
FIG. 2 is a cross-sectional view of a first electrical connector of the connector system.

FIG. 2 is a cross-sectional view of the receptacle connector 102 taken along line 2-2 shown in FIG. 1. The cross-section is taken across six columns 156 (shown in FIG. 1) of signal conductors 150 and ground conductors 152. The cross-section shows three signal conductors 150 within three corresponding signal cavities 146 and three ground conductors 152 within three corresponding ground cavities 148. The signal cavities 146 and the ground cavities 148 extend continuously through the housing stack 130 between the mating end 132 and the mounting end 134. The modules of the housing stack 130 (for example, the front housing 136, the rear housing 138, and any spacer members 138) each define portions of the signal cavities 146 and the ground cavities 148. The portions extend between a front side and a rear side of each module. The portions of two adjacent modules align with one another such that the signal and ground cavities 146, 148 extend continuously through the housing stack 130.

The signal and ground conductors 150, 152 are electrically conductive and are formed of a conductive material, such as copper, a copper alloy, silver, or another metal or metal alloy. The signal and ground conductors 150, 152 may be stamped and formed from a sheet or panel of metal. The signal conductors 150 and ground conductors 152 each include a mating interface 162, the terminating interface 158, and a stem 164 that extends between the mating interface 162 and the terminating interface 158. In an embodiment, the mating interface 162 of each of the signal conductors 150 and the ground conductors 152 is a tuning-fork style interface that is configured to engage a corresponding pin 128 (shown in FIG. 1) of the header connector 104 (FIG. 1). In other embodiments, the mating interface 162 of the signal conductors 150 and/or the ground conductors 152 may be a pin, a socket, or the like, instead of a tuning-fork style interface. The mating interfaces 162 of the signal and ground conductors 150, 152 are located axially within the front housing 136, or more specifically within portions 166 of the signal cavities 146 and the ground cavities 148 defined by the front housing 136. Alternatively, the mating interfaces 162 may extend beyond the front side 140 of the front housing 136. As described above, the terminating interfaces 158 of the signal conductors 150 and the ground conductors 152 extend beyond or protrude from the rear side 142 of the rear housing 138 for termination to the circuit board 106 (shown in FIG. 1). The stems 164 of the signal conductors 150 and the ground conductors 152 extend through the remaining lengths of the corresponding signal and ground cavities 146, 148 between the mating interfaces 162 and the terminating interfaces 158. For example, each stem 164 may extend through a substantial entirety of the rear housing 138 and through the intervening spacer members 138.

As shown in FIG. 2, the ground brackets 160 each define a ground plane 168 that is transverse to the stack axis 144 (and/or parallel to the mating end 132 and the mounting end 134). For example, all or some of the ground brackets 160 may be perpendicular to the stack axis 144. Since the signal and ground conductors 150, 152 may extend substantially parallel to the stack axis 144, the ground brackets 160 extend across the signal and ground conductors 150, 152. As shown and described in more detail below with reference to FIG. 6, the ground brackets 160 each define a plurality of openings, such as windows 170 and ground slots 172 (referred to herein simply as "slots"). The windows 170 are configured to accommodate the signal conductors 150, such that at least one signal conductor 150 (for example, a signal pair of signal conductors 150) extends through each window 170. The slots 172 are configured to accommodate the ground conductors 152, such that a single ground conductor 152 extends through a single corresponding slot 172. Therefore, the windows 170 each align with one or more signal cavities 146 of the housing stack 130, and the slots 172 each align with one of the ground cavities 148.

In an exemplary embodiment, at least one edge 174 of each slot 172 of each ground bracket 160 is configured to engage the corresponding ground conductor 152 that extends through that slot 172 to provide an electrical connection between the ground bracket 160 and the corresponding ground conductor 152. Since each of the slots 172 of a corresponding ground bracket 160 engage a different ground conductor 152, the ground bracket 160 creates a conductive ground circuit along the ground plane 168 that electrically commons each of the ground conductors 152 engaged by the edges 174 of the slots 172. In an embodiment, the windows 170 are sized larger than the signal cavities 146 such that a clearance exists between edges of the windows 170 and the corresponding signal conductors 150 that extend through the windows 170. The ground bracket 160 as a result does not directly engage the signal conductors 150 to avoid producing an electrical short or other damage.

In the illustrated embodiment and other embodiments in which the receptacle connector 102 includes multiple ground brackets 160, the ground conductors 152 are electrically connected to different ground brackets 160 at different locations along the length of the ground conductors 152. For example, the first ground bracket 160A (between the front housing 136 and the first spacer member 138A) engages the stems 164 of the ground conductors 152 at a first location proximate to the mating interface 162. The second ground bracket 160B (between the first spacer member 138A and the second spacer member 138B) engages the stems 164 of the ground conductors 152 at a second location that is more proximate to the terminating interface 158 than the proximity of the first location to the terminating interface 158. The third ground bracket 160C (between the second spacer member 138B and the rear housing 138C) engages the stems 164 at a third location that is more proximate to the terminating interface 158 than the proximity of the second location (and the first location) to the terminating interface 158. Thus, the ground conductors 152 are each electrically commoned at three different locations along the length of stem 164 within the housing stack 130 via the ground brackets 160A-160C (in addition to grounding that occurs between the terminating interfaces 158 via the first circuit board 106 (shown in FIG. 1)). The redundant grounding at multiple axial locations reduces the ground path length between grounding locations, which may improve signal integrity by reducing resonance noise and crosstalk, reducing the magnitude of resonance peaks in resonance waves that propagate through the ground conductors 152, and/or increasing the resonance frequency of the ground conductors 152 to a value outside of a desired operating frequency range or band.

In an embodiment, the signal conductors 150 and the ground conductors 152 each include at least one T-shaped stop shoulder 176 that is used to retain the respective conductor 150, 152 in a designated axial position within the housing stack 130. In the illustrated embodiment, the stop shoulders 176 of the signal and ground conductors 150, 152 are integral to the conductors 150, 152 and are located on the stems 164 proximate to the mating interfaces 162. The stop shoulders 176 may be sandwiched between the front housing 136 and the first spacer member 138A to lock the axial position of the conductors 150, 152. Optionally, the stop shoulders 176 of the ground conductors 152 are configured to engage the first ground bracket 160A, while the stop shoulders 176 of the signal conductors 150 do not engage the first ground bracket 160A, engaging the first spacer member 138A instead. As shown in FIG. 2, the stems 164 of the ground conductors 152 are wider than the stems 164 of the signal conductors 150. The width of the signal conductors 150 may be selected based on a desired impedance of the receptacle connector 102. In other embodiments, the stems 164 of the signal conductors 150 may have an equal width or a greater width than the stems 164 of the ground conductors 152.

Figure 4:
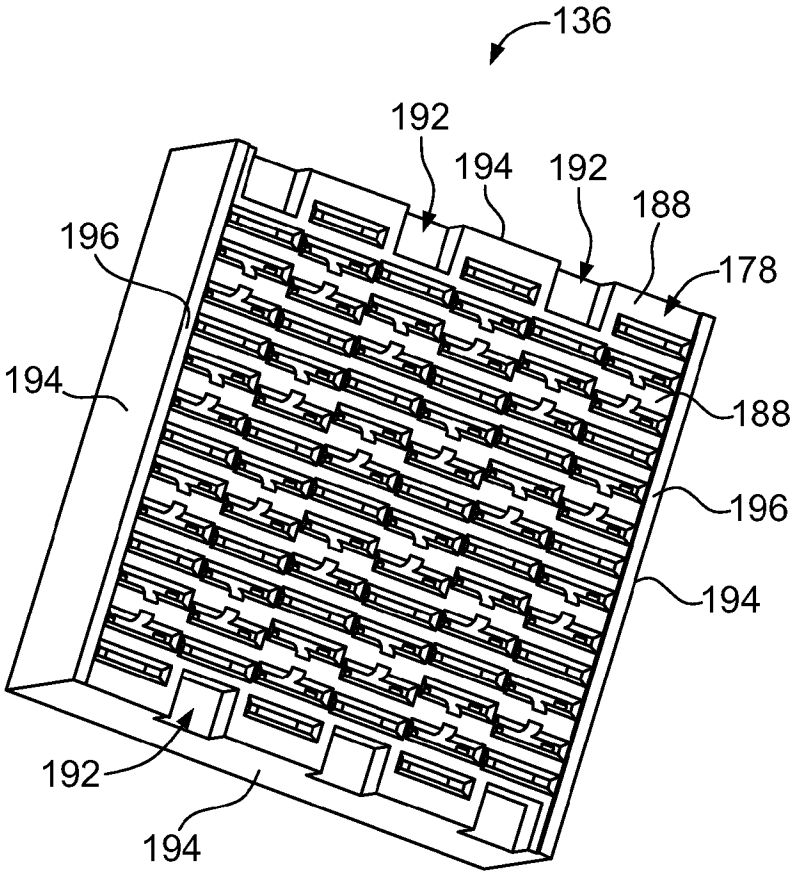
FIG. 4 is a rear perspective view of the front housing of the first electrical connector.
Figure 3:
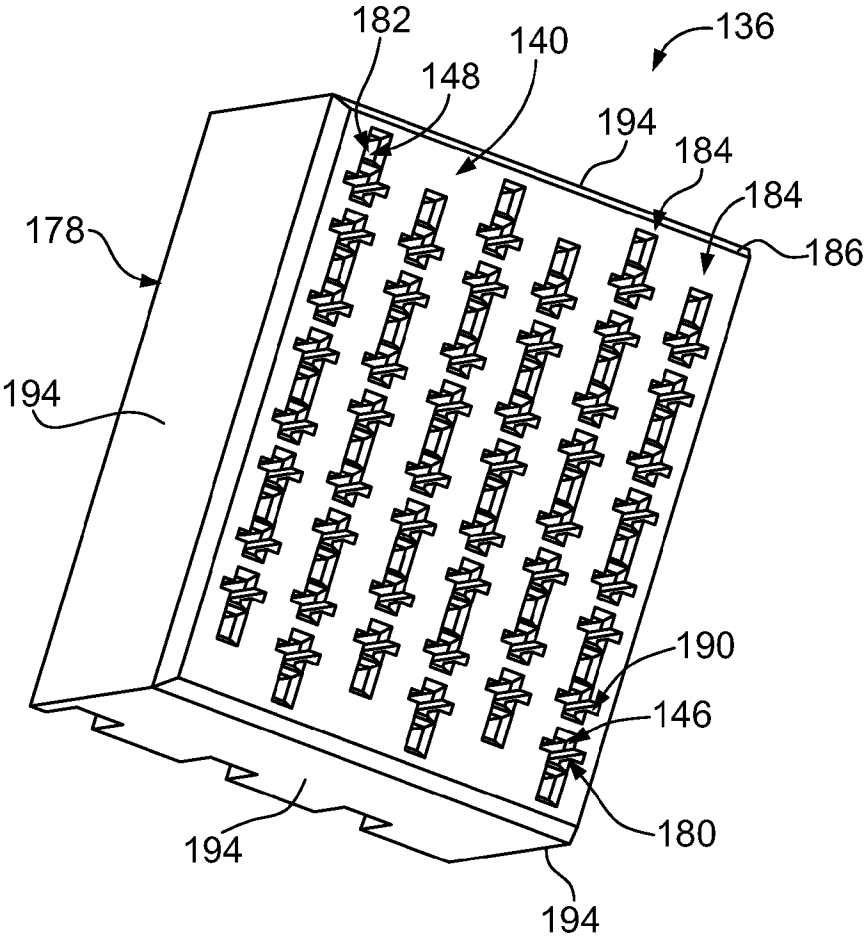
FIG. 3 is a front perspective view of a front housing of the first electrical connector according to an embodiment.

FIG. 3 is a front perspective view of the front housing 136 of the receptacle connector 102 (shown in FIG. 1) according to an embodiment. FIG. 4 is a rear perspective view of the front housing 136 of the receptacle connector 102. The front housing 136 extends between the front side 140 and a rear side 178. The front housing 136 has a rectangular or square-shaped cross-sectional area including four outer walls 194 that each extend between the front side 140 and the rear side 178. The front housing 136 is configured to fit within the socket 120 (shown in FIG. 1) of the header connector 104 (FIG. 1). The front side 140 defines the mating end 132 (FIG. 1) of the housing stack 130 (FIG. 1). The front side 140 defines signal openings 180 and ground openings 182. The signal openings 180 provide access to the signal cavities 146, and the ground openings 182 provide access to the ground cavities 148. For example, during mating, the pins 128 (shown in FIG. 1) of the signal contacts 114 (FIG. 1) are received in the signal cavities 146 through the signal openings 180, and the pins 128 of the ground contacts 116 (FIG. 1) are received in the ground cavities 148 through the ground openings 182.

The signal cavities 146 and the ground cavities 148 are arranged in plural columns 184. Six columns 184 are shown in FIGS. 3 and 4, but the front housing may define more or less than six columns 184 in other embodiments. In each column 184, the signal cavities 146 and the ground cavities 148 are arranged in a repeating GSSG pattern. Adjacent pairs of signal cavities 146 are separated by a single ground cavity 148 in the illustrated embodiment, although other variations of the GSSG pattern may be used in other embodiments. Optionally, adjacent columns 184 are staggered relative to a reference edge 186 of the front housing 136. The reference edge 186 is an edge of the front housing 136 (between the front side 140 and one of the outer walls 194) used as a point of reference. For example, the signal cavities 146 and the ground cavities 148 of one column 184 may be offset from the signal cavities 146 and the ground cavities 148 of an adjacent column 184 at respective different distances from the reference edge 186. The cavities 146, 148 of adjacent columns 184 may be offset by a half pitch, a full pitch, or the like. A "pitch" as used herein refers to the distance between the centers of adjacent cavities 146, 148 in the same column 184. Staggering the columns 184 of cavities 146, 148 increases the distance between signal conductors 150 (shown in FIG. 2) held in adjacent columns 184, which may improve signal integrity by reducing crosstalk. Optionally, the signal cavities 146 along the front housing 136 may include cutouts 190 for impedance tuning at the mating interface.

Referring now specifically to FIG. 4, the rear side 178 of the front housing 136 includes a rear face 188 which is generally planar. In an embodiment, the front housing 136 defines multiple pockets 192 in the rear face 188. The pockets 192 are located proximate to at least two outer walls 194 of the front housing 136. In the illustrated embodiment, the pockets 192 are located proximate to two opposing outer walls 194. Optionally, the rear side 178 may also define at least one ledge 196 extending rearward from the rear face 188 along another outer wall 194. Two ledges 196 located along opposing outer walls 194 are shown in FIG. 4. As described below with reference to FIG. 5, the pockets 192 and/or the ledges 196 are used to align the front housing 136 with the rear housing 138 (or a spacer member 138).

Figure 5:
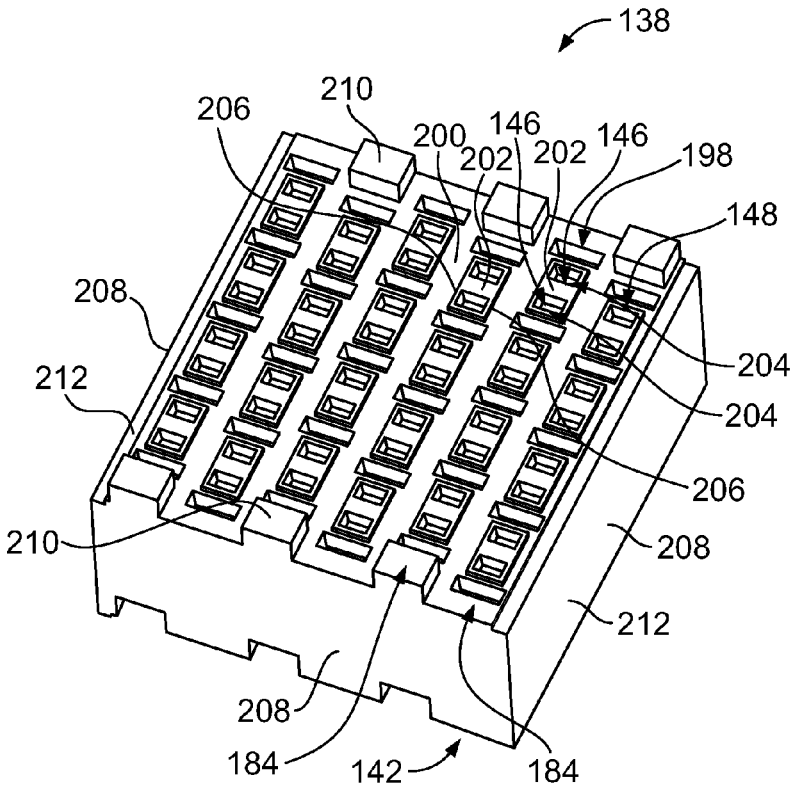
FIG. 5 is a front perspective view of a rear housing of the first electrical connector according to an embodiment.

FIG. 5 is a front perspective view of the rear housing 138 of the receptacle connector 102 according to an embodiment. It is recognized that the following description of the rear housing 138 may also apply to one or more of the spacer members 138 (shown in FIG. 1). The rear housing 138 extends between the rear side 142 and a front side 198. The rear housing 138 includes four outer walls 208 that extend between the front side 198 and the rear side 142. The front side 198 includes a generally planar front face 200. In an embodiment, the front side 198 of the rear housing 138 includes pads 202 that extend from and are raised relative to the front face 200. Each pad 202 surrounds and/or encases a pair of signal cavities 146. For example, the pad 202 defines a pair of signal openings 204 that provide access to the signal cavities 146. The outer edges 206 of each pad 202 are configured to engage corresponding edges 226 (shown in FIG. 6) of the windows 170 (FIG. 6) of a corresponding ground bracket 160 (FIG. 6) to isolate the signal conductors 150 (shown in FIG. 2) from the ground bracket 160.

The front side 198 of the rear housing 138 optionally includes multiple lugs 210 that protrude from the front face 200 proximate to at least one of the outer walls 208. In FIG. 5, the lugs 210 are arranged along two opposing outer walls 208. The lugs 210 are configured to be received in corresponding pockets 192 (shown in FIG. 4) that are defined in the rear face 188 (FIG. 4) of the front housing 136 (FIG. 4). The lugs 210 may have a complementary shape to the shape of the pockets 192. In the illustrated embodiment, the lugs 210 have a rectangular cuboid shape, but other sizes and shapes are possible in other embodiments. The interaction between the lugs 210 of the rear housing 138 and the pockets 192 of the front housing 136 may help to align the rear housing 138 with the front housing 136 and/or to retain engagement between the rear housing 138 and the front housing 136. For example, the lugs 210 and pockets 192 may be sized and shaped such that the lugs 210 are held in the pockets 192 by an interference fit, which supports the coupling between the rear housing 138 and the front housing 136. The alignment provided by the lugs 210 and the pockets 192 ensures that the portions 166 (shown in FIG. 2) of the signal cavities 146 and the ground cavities 148 of the front housing 136 align with the corresponding portions of the signal cavities 146 and the ground cavities 148 of the rear housing 138.

Optionally, the rear housing 138 also defines at least one shelf 212 that is recessed from the front face 200. Each shelf 212 may extend proximate to an outer wall 208. In FIG. 5, the rear housing 138 includes two shelves 212 that extend along opposing outer walls 208 adjacent to the outer walls 208 that are near the lugs 210. The shelves 212 are configured to receive the ledges 196 (shown in FIG. 4) of the front housing 136 to align the rear housing 138 with the front housing 136.

Figure 6:
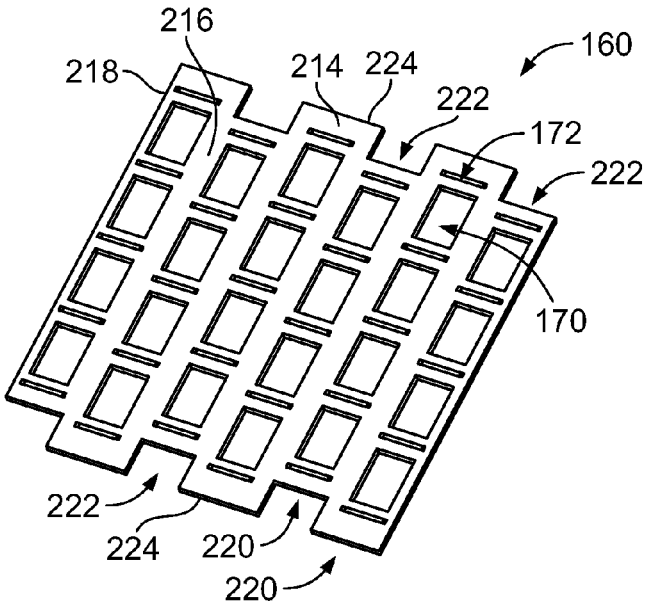
FIG. 6 is a perspective view of a ground bracket of the first electrical connector according to an embodiment.

FIG. 6 is a perspective view of the ground bracket 160 of the receptacle connector 102 (shown in FIG. 1) according to an embodiment. The ground bracket 160 has a planar body 214 that includes a first side 216 and an opposite second side 218. In an embodiment, the planar body 214 is a metal plate. The ground bracket 160 is configured to be placed on the front side 198 (shown in FIG. 5) of the rear housing 138 (or a spacer member 138) (FIG. 5) such that the second side 218 faces the front face 200 (FIG. 5) of the rear housing 138. The second side 218 may abut against the front face 200. The first side 216 of the ground bracket 160 is configured to face (and possibly abut against) the rear face 188 (shown in FIG. 4) of the front housing 136 (FIG. 4). The ground bracket 160 is formed of a conductive material, such as copper, a copper alloy, silver, or another metal or metal alloy. For example, the ground bracket 160 may be stamped and formed from a plate, panel, or sheet of metal. Alternatively, the ground bracket 160 may include a dielectric material that is plated with a metal material to provide electrically conductive properties.

The ground bracket 160 includes the windows 170 and the slots 172. The windows 170 and slots 172 are arranged in multiple, staggered columns 220 that align with the columns 184 (shown in FIG. 5) of signal and ground cavities 146, 148 (FIG. 5). In each column 220, the windows 170 and the slots 172 alternate along the length of the column 220. The ground bracket 160 may define cutout portions 222 along two ends 224 of the ground bracket 160. The cutout portions 222 are designed to accommodate the lugs 210 (shown in FIG. 5) of the rear housing 138. In an embodiment, the three ground brackets 160A, 160B, 160C, shown in FIGS. 1 and 2 may all have substantially identical shapes and sizes, such that the description of the ground bracket 160 in FIG. 6 applies to each of the ground brackets 160A-160C.

Figure 7:
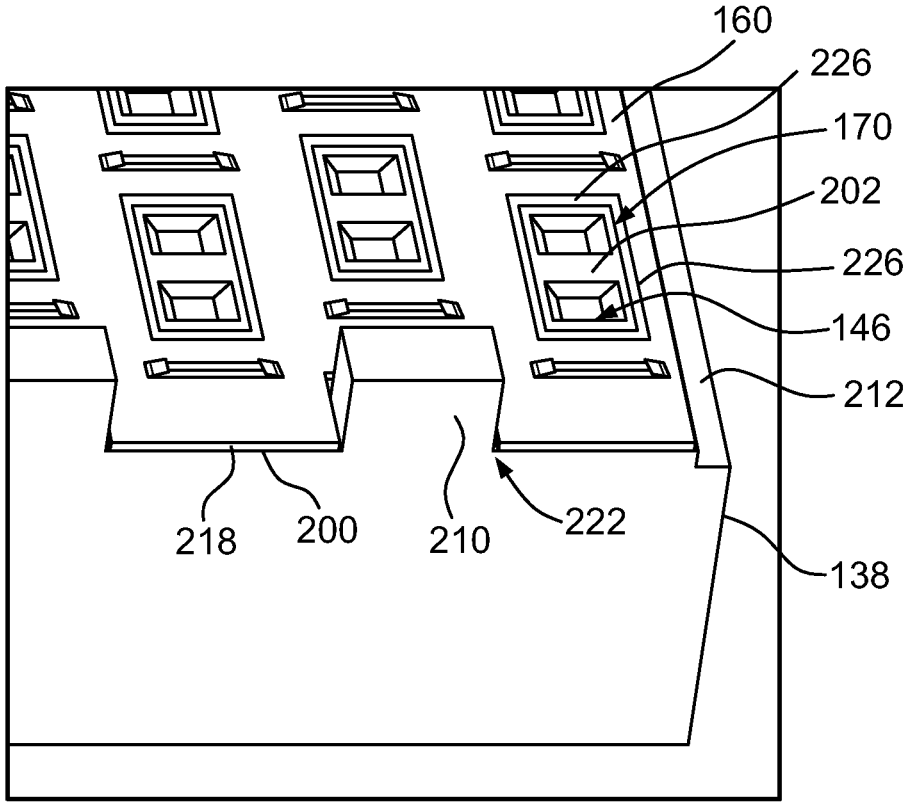
FIG. 7 is a perspective view of a portion of the rear housing and the ground bracket of the first electrical connector according to an embodiment.

FIG. 7 is a perspective view of a portion of the rear housing 138 and the ground bracket 160 of the receptacle connector 102 (shown in FIG. 1) according to an embodiment. In an embodiment, the second side 218 of the ground bracket 160 abuts against the front face 200 of the rear housing 138. The lugs 210 project through the cutout portions 222 of the ground bracket 160. The pads 202 of the rear housing 138, which are raised relative to the front face 200, extend at least partially through the corresponding windows 170 of the ground bracket 160. The pads 202 provide electrical insulation between the conductive edges 226 of the windows 170 and the signal conductors 150 (shown in FIG. 2) that are within the signal cavities 146 in order to ensure that the ground bracket 160 does not engage the signal conductors 150. The ground bracket 160 does not extend laterally over the shelf 212 of the rear housing 138, which allows the ledge 196 (shown in FIG. 4) of the front housing 136 (FIG. 4) to access and engage the shelf 212.

Figure 8:
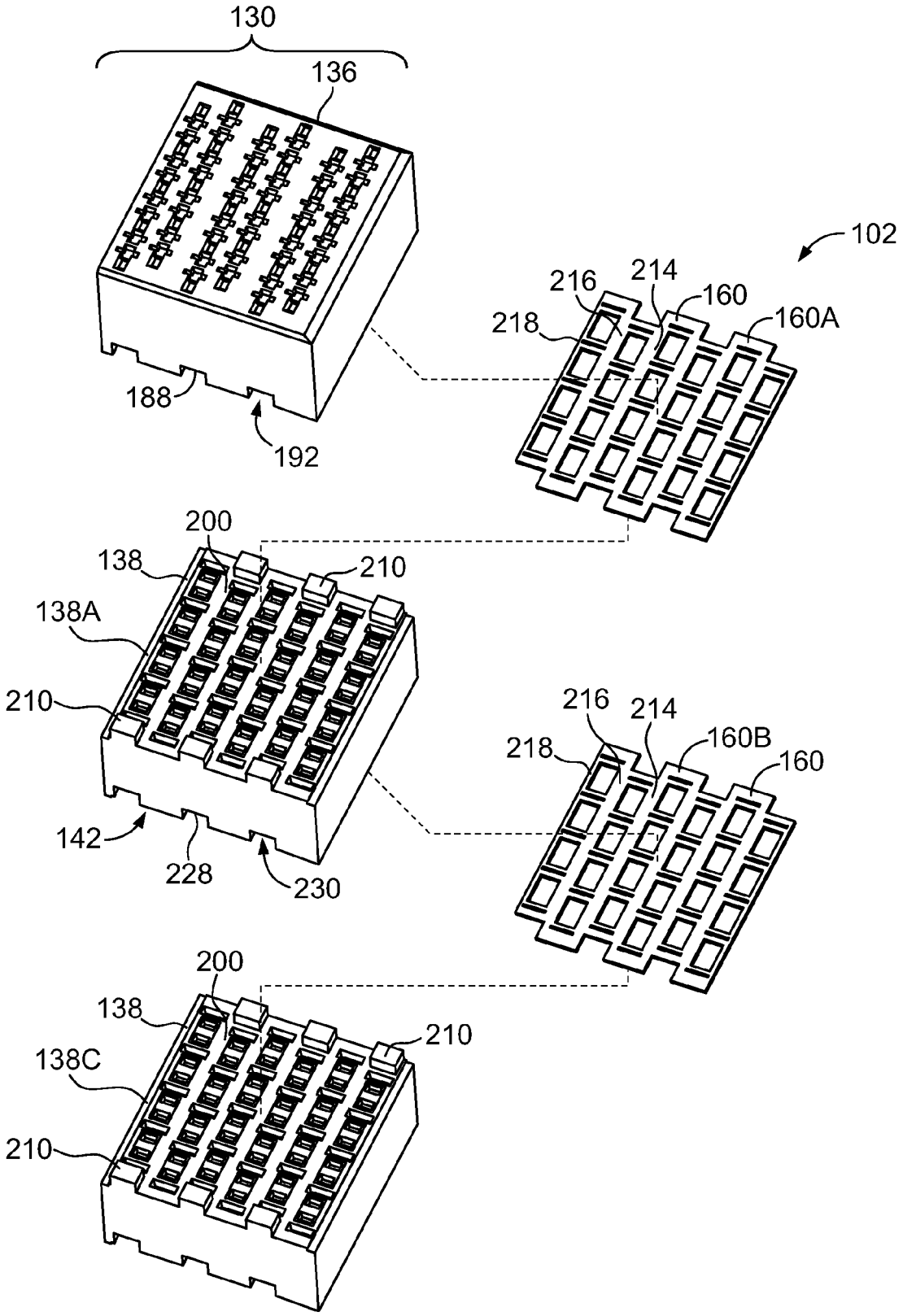
FIG. 8 is an exploded view of the first electrical connector according to an embodiment.

FIG. 8 is an exploded view of the receptacle connector 102 according to an embodiment. The signal conductors 150 and ground conductors 152 (both shown in FIGS. 1 and 2) are not shown in FIG. 8. In the illustrated embodiment, the housing stack 130 includes the front housing 136, the rear housing 138, and one spacer member 138 disposed between the front housing 136 and the rear housing 138. As described above, the housing stack 130 is configured to be stackable by adding and/or removing spacer members 138 in order to achieve a desired stack height of the receptacle connector 102. For example, the shortest version of the housing stack 130 may include the front housing 136 and the rear housing 138 alone without any spacer members 138. In order to keep the numbering consistent, the rear housing 138 in FIG. 8 is designated "138C" and the single spacer member 138 is designated "138A". The spacer member 138A and the rear housing 138C are substantially identical, so components of the spacer member 138A are numbered consistently with components of the rear housing 138C.

In the illustrated embodiment, two ground brackets 160 are held in the housing stack 130 between the stackable modules. Each of the ground brackets 160 has a planar body 214 that includes a first side 216 and an opposite second side 218. A first ground bracket 160A is located between the front housing 136 and the spacer member 138A, and a second ground bracket 160B is located between the spacer member 138A and the rear housing 138C. In an embodiment, the first side 216 of the first ground bracket 160A abuts the rear face 188 of the front housing 136, and the second side 218 of the first ground bracket 160A abuts the front face 200 of the spacer member 138A. In an alternative embodiment with no spacer members 138, the first ground bracket 160A is the only ground bracket 160, and the second side 218 of the ground bracket 160 abuts the rear housing 138C directly. Referring now back to the illustrated embodiment, the first side 216 of the second ground bus 160B abuts a rear face 228 of the spacer member 138A along the rear side 142 of the spacer member 138A, and the second side 218 of the second ground bus 160B abuts the front face 200 of the rear housing 138C (or another intervening spacer member 138). The rear face 228 of the spacer member 138A (and/or the rear housing 138C) may be similar to the rear face 188 of the front housing 136 that is shown in FIG. 4, such that the rear face 228 defines pockets 230 that are sized to receive the lugs 210 of the rear housing 138C (or another intervening spacer member 138) for alignment and/or coupling purposes.

During assembly, the first and second ground brackets 160A, 160B may be placed onto the front faces 200 of the spacer member 138A and the rear housing 138C, respectively. Then, the housing modules are stacked upon one another such that the ground brackets 160 are sandwiched between the housing modules. The lugs 210 of the rear housing 138C are received in the pockets 230 of the spacer member 138A, and the lugs 210 of the spacer member 138A are received in the pockets 192 of the front housing 136. Although not shown, mechanical fasteners and/or chemical adhesives may be used to secure the housing modules to one another after or while the housing stack 130 is formed. For example, latches, clamps, screws, bolts, and other mechanical fasteners may be installed to secure the front housing 136, the rear housing 138, and any intervening spacer members 138 together. Adhesives such as glue and tape may be used instead of or in addition to the mechanical fasteners.

Figure 9:
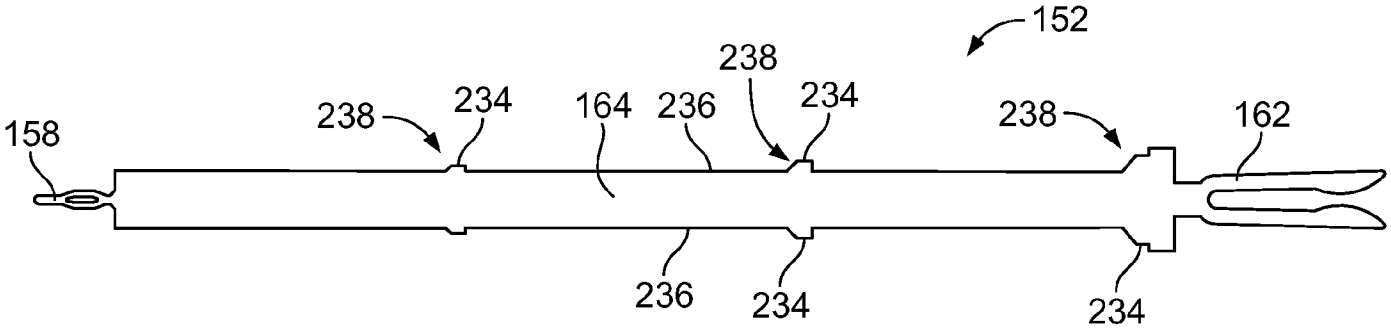
FIG. 9 shows one ground conductor of the first electrical connector according to an embodiment.
Figure 10:
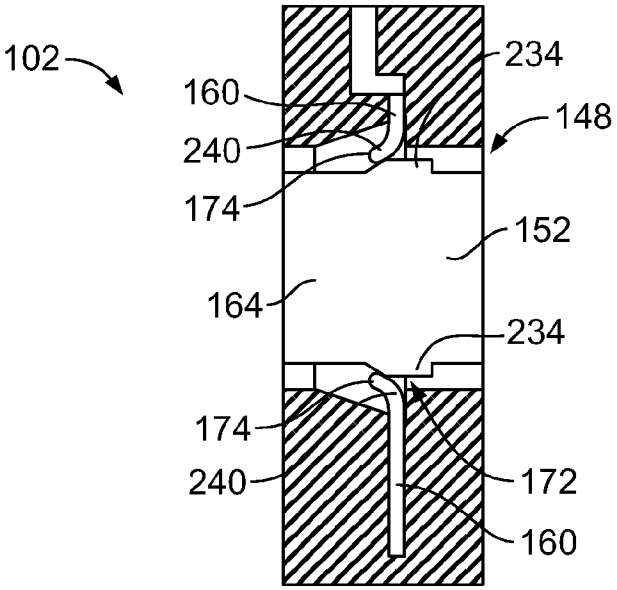
FIG. 10 is a close-up cross-sectional view of a portion of the first electrical connector according to an embodiment.

FIG. 9 shows one ground conductor 152 of the receptacle connector 102 (shown in FIG. 1) according to an embodiment. FIG. 10 is a close-up cross-sectional view of a portion of the receptacle connector 102 according to an embodiment. As shown in FIG. 9, the ground conductors 152 of the receptacle connector 102 may optionally include barbs 234 or sets 238 of barbs 234 at one or more locations along the length of the longitudinal stems 164. The barbs 234 extend laterally from side edges 236 of the stems 164. The barbs 234 may be integral to the stems 164. The barbs 234 are configured to provide a contact interface for engaging the edges 174 of the slots 172 of each ground bracket 160 to electrically connect the ground conductors 152 to the ground brackets 160. In FIG. 9, the ground conductor 152 includes three sets 238 of two barbs 234 that are spaced apart to engage the three ground brackets 160A-160C shown in FIG. 1.

Referring now to FIG. 10, in an embodiment, at least one of the edges 174 of each slot 172 of the ground bracket 160 includes a deflectable tab 240 that extends at least partially into the corresponding slot 172. In the illustrated embodiment, the slot 172 includes two deflectable tabs 240 that extend from or along opposite edges 174 of the slot 172. The deflectable tabs 240 are configured to apply a biasing force on the corresponding ground conductor 152 that extends through the slot 172 to retain mechanical engagement (and the electrical connection) between the ground bracket 160 and the ground conductor 152. The deflectable tabs 240 may engage the barbs 234 of the ground conductor 152, as shown in FIG. 10. In an alternative embodiment in which the ground conductor 152 does not include barbs 234, the deflectable tabs 240 may be configured to engage the stem 164 directly. In another alternative embodiment, the stem 164 of the ground conductor 152 defines deflectable tabs instead of or in addition to the edges 174 of the slot 172 of the ground bracket 160.

Optionally, as shown in FIG. 9, the barbs 234 in each set 238 of barbs 234 may have varying sizes (for example, extend different lateral distances from the stem 164). For example, the set 238 of barbs 234 most proximate to the mating interface 162 is the largest, while the set 238 most proximate to the terminating interface 158 is the smallest. The barbs 234 have varying sizes based on the loading direction of the ground conductor 152 into the ground cavity 148. For example, the ground conductor 152 shown in FIG. 9 may be configured to be loaded into the corresponding ground cavity 148 with the terminating interface 158 first. Thus, the smallest set 238 of barbs 234 near the terminating interface 158 engages the deflectable tabs 240 of each ground bracket 160 as the ground conductor 152 is moved in the loading direction. The progressive increase in size of the barbs 234 assures that a reliable connection is made between the barbs 234 and the corresponding deflectable tabs 240 that align with the barbs 234 when the ground conductor 152 is fully loaded within the ground cavity 148.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing stack comprising a front housing and a rear housing, the front housing defining a mating end of the housing stack, the rear housing defining a mounting end of the housing stack, the rear housing being positioned rearward of the front housing, the housing stack defining signal cavities and ground cavities that extend continuously through the front housing and the rear housing between the mating end and the mounting end;

signal conductors and ground conductors held in the signal cavities and ground cavities, respectively, of the housing stack, the signal conductors arranged in a plurality of signal pairs configured to carry differential signals, the ground conductors being interleaved between the signal pairs, the signal conductors and the ground conductors being stamped and formed, the signal conductors and the ground conductors including respective integral terminating interfaces extending beyond the mounting end of the housing stack to be mounted and electrically connected to a circuit board; and a ground bracket held in the housing stack between the front housing and the rear housing, the ground bracket being electrically conductive, the ground bracket engaging and being electrically connected to each of the ground conductors to electrically common the ground conductors along a ground plane intermediate between the mating end and the mounting end.

2. The electrical connector of claim 1, wherein the ground bracket is a metal plate having a plurality of openings, the signal conductors and the ground conductors extending through the corresponding openings, the ground bracket having tabs extending into the corresponding openings to physically engage the ground conductors to electrically connect the ground bracket to each of the ground conductors.

3. The electrical connector of claim 1, wherein the housing stack further includes a spacer member positioned between the front housing and the rear housing, the ground bracket being a first ground bracket that is disposed between the front housing and the spacer member, the ground plane provided by the first ground bracket being a first ground plane, and wherein the electrical connector further comprises a second ground bracket held in the housing stack, the second ground bracket being disposed between the spacer member and the rear housing, the second ground bracket being electrically conductive, the second ground bracket engaging and electrically connecting to each of the ground conductors to electrically common the ground conductors along a second ground plane that is spaced apart axially from the first ground plane.

4. The electrical connector of claim 1, wherein the housing stack extends along a stack axis between the mating end and the mounting end, the signal conductors and the ground conductors extending parallel to the stack axis, the ground bracket having a planar body that extends orthogonal to the stack axis.

5. The electrical connector of claim 1, wherein a front side of the rear housing includes lugs that protrude from a front face of the rear housing, each lug being received in a corresponding pocket defined in a rear face of the front housing to align the rear housing with the front housing.

6. The electrical connector of claim 1, wherein the ground bracket has a first side and an opposite second side, the first side of the ground bracket abutting a rear face of the front housing, the second side of the ground bracket abutting a front face of the rear housing.

7. The electrical connector of claim 1, wherein the signal cavities and the ground cavities of the housing stack are arranged in plural columns, the signal cavities and the ground cavities of adjacent columns being staggered such that the signal cavities and the ground cavities of the adjacent columns are offset at respective different distances from a reference edge of the housing stack.

8. The electrical connector of claim 1, wherein the respective terminating interfaces are pins configured to be received in corresponding vias of the circuit board.

9. The electrical connector of claim 1, wherein the signal conductors and the ground conductors include respective integral T-shaped stop shoulders that extend outward from the respective signal conductors and ground conductors, the stop shoulders of the ground conductors held between the front housing and the rear housing to lock the axial position of the ground conductors relative to the housing stack, the stop shoulders of the ground conductors engaging the ground bracket to electrically connect the ground conductors to the ground bracket.

10. The electrical connector of claim 1, wherein the ground bracket defines windows and ground slots, each signal pair of the signal conductors extending through a corresponding window, each ground conductor extending through a corresponding ground slot, at least one edge of each of the ground slots engaging the corresponding ground conductor that extends through the ground slot to electrically common the ground conductors along the ground bracket.

11. The electrical connector of claim 10, wherein the at least one edge of each of the ground slots includes at least one deflectable tab that extends at least partially into the corresponding ground slot, the at least one deflectable tab of each ground slot applying a biasing force on the corresponding ground conductor that extends through the ground slot to retain engagement with the corresponding ground conductor.

12. The electrical connector of claim 10, wherein the ground conductors each include a longitudinal stem and at least one set of barbs that extend laterally from the stem to engage the at least one edge of the corresponding ground slot of the ground bracket to engage and electrically connect the respective ground conductor to the ground bracket.

13. An electrical connector comprising:

a housing stack comprising a front housing and a rear housing, the front housing defining a mating end of the housing stack, the rear housing defining a mounting end of the housing stack, the rear housing being positioned rearward of the front housing, the housing stack defining signal cavities and ground cavities that extend continuously through the front housing and the rear housing between the mating end and the mounting end;

signal conductors and ground conductors held in the signal cavities and ground cavities, respectively, of the housing stack, the signal conductors arranged in a plurality of signal pairs configured to carry differential signals, the ground conductors being interleaved between the signal pairs; and a ground bracket held in the housing stack between the front housing and the rear housing, the ground bracket being electrically conductive, the ground bracket engaging and being electrically connected to each of the ground conductors to electrically common the ground conductors along a ground plane intermediate between the mating end and the mounting end;

wherein the ground bracket defines windows and ground slots, each signal pair of the signal conductors extending through a corresponding window, each ground conductor extending through a corresponding ground slot, wherein a front side of the rear housing includes pads that are raised relative to a front face of the rear housing, each pad defining a pair of signal openings for two corresponding signal cavities, the pads each extending at least partially through the corresponding window of the ground bracket, the pads each configured to isolate the corresponding signal pair of signal conductors that extends through the signal openings of the pad from the ground bracket.

14. An electrical connector comprising:

a housing stack comprising a front housing, a spacer member, and a rear housing, the front housing defining a mating end of the housing stack, the rear housing defining a mounting end of the housing stack, the spacer member being disposed between the front housing and the rear housing, the housing stack defining signal cavities and ground cavities that extend continuously through the front housing, the spacer member, and the rear housing between the mating end and the mounting end;

signal conductors and ground conductors held in the signal cavities and ground cavities, respectively, of the housing stack, the signal conductors arranged in a plurality of signal pairs configured to carry differential signals, the ground conductors being interleaved between the signal pairs; and first and second ground brackets held in the housing stack, the first and second ground brackets each being electrically conductive, the first ground bracket being disposed between the front housing and the spacer member, the first ground bracket engaging and electrically connecting to each of the ground conductors to electrically common the ground conductors along a first ground plane, the second ground bracket being disposed between the spacer member and the rear housing, the second ground bracket engaging and being electrically connected to each of the ground conductors to electrically common the ground conductors along a second ground plane that is spaced apart axially from the first ground plane, the first ground plane and the second ground plane being located between the mating end and the mounting end.

15. The electrical connector of claim 14, wherein the first ground bracket and the second ground bracket each define openings, the signal conductors and the ground conductors extending through the corresponding openings of the first ground bracket and the second ground bracket, the first and second ground brackets having tabs extending into the corresponding openings to physically engage the ground conductors to electrically connect the first ground bracket and the second ground bracket to each of the ground conductors.

16. The electrical connector of claim 14, wherein the rear housing and the spacer member are substantially identical to one another.

17. The electrical connector of claim 14, wherein a front side of the spacer member includes lugs that protrude from a front face of the spacer member, each lug being received in a corresponding pocket defined in a rear face of the front housing to align the spacer member with the front housing, and wherein a rear face of the spacer member defines pockets therein, each pocket receiving a corresponding lug that protrudes from a front face of the rear housing in order to align the spacer member with the rear housing.

18. The electrical connector of claim 14, wherein the first ground bracket and the second ground bracket each have a planar body that includes a first side and an opposite second side, the first side of the first ground bracket abutting a rear face of the front housing, the second side of the first ground bracket abutting a front face of the spacer member, the first side of the second ground bracket abutting a rear face of the spacer member, the second side of the second ground bracket abutting a front face of the rear housing.

19. The electrical connector of claim 14, wherein each ground conductor includes a mating interface, a terminating interface, and a stem that extends between the mating interface and the terminating interface, the first ground bracket engaging the stems of the ground conductors at a first location along a length of the stems, the second ground bracket engaging the stems of the ground conductors at a different, second location along the length of the stems.

20. The electrical connector of claim 14, wherein the spacer member is a first spacer member, the housing stack further including a second spacer member disposed between the first spacer member and the rear housing, and wherein the electrical connector further comprises a third ground bracket held in the housing stack, the second ground bracket being disposed between the first spacer member and the second spacer member, the third ground bracket being disposed between the second spacer member and the rear housing, the third ground bracket being electrically conductive, the third ground bracket engaging and electrically connecting to each of the ground conductors to electrically common the ground conductors along a third ground plane that is spaced apart axially from the first ground plane and the second ground plane.

* * * * *